US009683533B2

(12) United States Patent
Harada

(10) Patent No.: US 9,683,533 B2
(45) Date of Patent: Jun. 20, 2017

(54) FUEL INJECTOR RAIL ASSEMBLY FOR DIRECT INJECTION OF FUEL

(71) Applicant: MARUYASU INDUSTRIES CO., LTD., Nagoya-shi, Aichi (JP)

(72) Inventor: Naruki Harada, Nagoya (JP)

(73) Assignee: MARUYASU INDUSTRIES CO., LTD., Nagoya-Shi, Aichi (JP)

( * ) Notice: Subject to any disclaimer, the term of this patent is extended or adjusted under 35 U.S.C. 154(b) by 218 days.

(21) Appl. No.: 14/560,575

(22) Filed: Dec. 4, 2014

(65) Prior Publication Data

US 2015/0176556 A1 Jun. 25, 2015

(30) Foreign Application Priority Data

Dec. 19, 2013 (JP) ..... 2013-262902

(51) Int. Cl.
*F02M 63/02* (2006.01)
*F02M 61/14* (2006.01)
*F02M 55/02* (2006.01)

(52) U.S. Cl.
CPC ..... *F02M 61/14* (2013.01); *F02M 55/025* (2013.01); *F02M 2200/8053* (2013.01); *F02M 2200/856* (2013.01); *F02M 2200/857* (2013.01)

(58) Field of Classification Search
CPC ..... F02M 61/14; F02M 5/025; F02M 2200/8053; F02M 2200/856; F02M 2200/857
USPC ..... 123/445, 448, 452, 454, 456, 468, 469; 285/24, 33; 138/140, 141, 142, 143, 147, 138/152, 157, 162, 166
See application file for complete search history.

(56) References Cited

U.S. PATENT DOCUMENTS 2,297,013 A * 9/1942 Nichols ..... B21C 37/298 285/133.11
3,502,357 A * 3/1970 Wagner ..... E04F 11/1817 285/133.11
4,220,243 A * 9/1980 Frost ..... B65G 17/20 104/89
5,072,710 A * 12/1991 Washizu ..... F02M 69/465 123/456

(Continued)

*Primary Examiner* — Hung Q Nguyen
*Assistant Examiner* — John Bailey
(74) *Attorney, Agent, or Firm* — Nixon & Vanderhye P.C.

(57) ABSTRACT

A fuel injector rail assembly for direct injection of fuel includes an elongate fuel distribution tube, a plurality of fuel injector sockets each formed to contain therein a fuel injection valve and being integrally secured to the fuel distribution tube, and a plurality of brackets each integrally secured to the distribution tube. The brackets each are made of pressed sheet metal and includes a mounting plate portion formed with a bolt hole for mounting the fuel distribution tube on an engine head and an opening for permitting each lower portion of the fuel injector sockets inserting therethrough, a pair of stationary arm portions extended in parallel from one side edge of the mounting plate portion at opposite sides of the respective fuel injector sockets and secured to the distribution tube. An outward flange formed at each lower end of the injector sockets is secured to an underside surface of the periphery of the opening for each injector socket. A central axis of the bolt hole is offset from a central axis of each of the fuel injector sockets in a longitudinal direction of the fuel distribution tube.

7 Claims, 3 Drawing Sheets

(56) References Cited

U.S. PATENT DOCUMENTS 5,079,671 A * 1/1992 Garrett ..... H01R 12/716 361/600
5,197,436 A * 3/1993 Ozawa ..... F02B 75/22 123/456
5,211,149 A * 5/1993 DeGrace, Jr. ..... F02M 51/005 123/456
5,334,818 A * 8/1994 Edwards ..... H05B 3/16 219/537
5,513,613 A * 5/1996 Taylor ..... F02M 51/005 123/456
5,568,798 A * 10/1996 Lorraine ..... F02M 51/005 123/456
5,735,247 A * 4/1998 Tsuzuki ..... F02M 51/005 123/456
5,876,020 A * 3/1999 Giavotto ..... E01F 15/0423 256/1
6,073,612 A * 6/2000 Ohkubo ..... F02M 55/025 123/456
6,341,595 B1 * 1/2002 Scollard ..... F02M 55/004 123/456
6,470,859 B2 * 10/2002 Imura ..... F02M 55/04 123/447
6,644,279 B1 * 11/2003 Frank ..... F02M 55/025 123/447
6,651,627 B2 * 11/2003 Zdroik ..... F02M 55/04 123/456
6,725,839 B2 * 4/2004 Zdroik ..... F02M 69/465 123/456
6,860,517 B2 * 3/2005 Sanders ..... B21C 37/292 285/133.11
6,889,660 B2 * 5/2005 Usui ..... F02M 55/004 123/456
7,028,668 B1 * 4/2006 West ..... F02M 55/025 123/456
7,159,569 B2 * 1/2007 Keegan ..... F02M 55/02 123/456
7,347,190 B1 * 3/2008 Keegan ..... F02M 55/02 123/456
7,406,946 B1 * 8/2008 Watanabe ..... F02M 55/005 123/456
7,516,735 B1 * 4/2009 Doherty ..... F02M 55/005 123/468
7,753,031 B2 * 7/2010 Akagi ..... F02M 69/042 123/469
8,596,246 B2 * 12/2013 Nishizawa ..... F02M 55/025 123/469
8,739,763 B2 * 6/2014 Harvey ..... F02M 55/02 123/470
9,133,799 B2 * 9/2015 Takasaki ..... F02M 55/025
9,151,261 B2 * 10/2015 Roussel ..... F02M 35/10078
9,212,641 B2 * 12/2015 Nakamura ..... F02M 55/02
2002/0108660 A1 * 8/2002 Braun ..... B29C 45/1642 138/30
2003/0172911 A1 * 9/2003 Nishiwaki ..... F02M 61/14 123/456
2003/0213472 A1 * 11/2003 Suzuki ..... F02M 55/025 123/469
2003/0221672 A1 * 12/2003 Zdroik ..... F02M 69/465 123/456
2004/0050364 A1 * 3/2004 Yanagii ..... F02M 55/025 123/456
2004/0118382 A1 * 6/2004 Usui ..... F02M 55/004 123/456
2005/0257774 A1 * 11/2005 Usui ..... F02M 55/025 123/456
2006/0254563 A1 * 11/2006 Keegan ..... F02M 55/02 123/456
2008/0238048 A1 * 10/2008 Ishida ..... B60R 21/2032 280/728.2
2009/0145504 A1 6/2009 Colletti et al.
2009/0241904 A1 * 10/2009 Sugiyama ..... F02M 55/005 123/468
2010/0300406 A1 * 12/2010 Harvey ..... F02M 55/025 123/456
2010/0300409 A1 * 12/2010 Harvey ..... F02M 61/14 123/470
2012/0017875 A1 * 1/2012 Ishiki ..... F02M 55/02 123/468
2012/0138020 A1 * 6/2012 Kweon ..... F02M 55/025 123/469
2014/0102415 A1 * 4/2014 Wyban ..... F02D 19/0647 123/456
2014/0123951 A1 * 5/2014 Imakita ..... F02M 55/025 123/469
2014/0305411 A1 * 10/2014 Ikoma ..... F02M 55/025 123/470
2015/0075496 A1 * 3/2015 Pasquali ..... F02M 61/14 123/469

* cited by examiner

FUEL INJECTOR RAIL ASSEMBLY FOR DIRECT INJECTION OF FUEL

CROSS-REFERENCE TO RELATED APPLICATIONS

This application claims priority rights based on Japanese Patent Application No. 2013-262902 filed Dec. 19, 2013, the entire contents of which are hereby incorporated by reference.

TECHNICAL FIELD

The present invention relates to a fuel injector rail assembly for direct injection of high pressure fuel into engine cylinders.

BACKGROUND

Disclosed in U.S. Patent Application Publication No. 2009/0145504 is a fuel injector rail assembly for direct injection of fuel under high pressure, which comprises an elongate fuel distribution tube formed therein with a fuel passage to be supplied with pressurized fuel from a fuel pump, four fuel injector sockets each formed to contain therein a fuel injection valve in a fluid-tight manner and being integrally secured to the fuel distribution tube, and four cylindrical bosses each formed with a hole for mounting the fuel distribution tube on an engine head by means of a bolt and being integrally secured to the fuel distribution tube. Because in the fuel injector rail assembly, the fuel injector sockets each are applied with a reaction force from the fuel injection valves inserted into each cylinder of the engine when fuel is directly injected into the cylinder, the mounting bosses are secured to the fuel distribution tube at a position adjacent the respective injector sockets to retain them in place.

The mounting bosses in the form of machined component parts are expensive to manufacture. Because the fuel injector sockets and the mounting bosses are respectively assembled to the fuel distribution tube, it is difficult to enhance precision of alignment of the component parts. It is, therefore, a primary object of the present invention to restrain the manufacturing cost of the fuel injector rail assembly. It is a further object of the present invention to enable precise alignment of the component parts of the fuel injector rail assembly in a simple manner.

BRIEF SUMMARY

According to the present example embodiment, there is provided a fuel injector rail assembly for direct injection of fuel which comprises an elongate fuel distribution tube formed therein with a fuel passage to be supplied with fuel under pressure from a fuel pump, a plurality of fuel injector sockets each formed to contain therein a fuel injection valve in a fluid-tight manner and being integrally secured to the fuel distribution tube, and a plurality of brackets each formed with a bolt hole for mounting the fuel distribution tube on an engine head and being integrally secured to the distribution tube, wherein the brackets each are made of pressed sheet metal and include a mounting plate portion formed with the bolt hole and an opening formed to permit insertion of each lower portion of the fuel injector sockets, wherein an outward flange formed at each lower end of said injector socket is secured to an underside surface of the periphery of the opening, and the brackets each include a pair of stationary arm portions extended in parallel upward from one side edge of the mounting plate portion and secured to an upper surface and one side surface of the distribution tube at opposite sides of each of the fuel injector sockets, and wherein a central axis of the bolt hole is offset from a central axis of each of the fuel injector sockets in a longitudinal direction of the distribution tube, and a stepped lateral rib is formed on the mounting plate portion of said bracket between the bolt hole and the opening for each of the injector sockets.

In the fuel injector rail assembly, it is advantageous that the brackets each made of pressed sheet metal can be manufactured at a low cost. Because the bolt hole and the injector socket opening are formed in the mounting portion of the bracket, the injector socket can be precisely positioned relative to the bolt hole. Because the outward radial flange formed on the lower end of fuel injector socket is secured to the underside surface of the mounting plate portion at a periphery of the injector socket opening, the mounting plate portion of each bracket receives an upward reaction force caused by ejection of fuel under high pressure from the fuel injection valve to restrain load acting on the fuel distribution tube.

As the pair of stationary arm portions of each bracket are secured to the upper surface and vertical planar side surface of the distribution tube at the opposite sides of each fuel injector socket, the brackets are firmly retained in place against load caused by vertical and lateral vibrations of the engine. In each bracket, the central axis of the bolt hole is offset relative to the central axis of the fuel injector socket in the longitudinal direction of the distribution tube. With such arrangement of the bolt hole, a bolt threaded into the bolt hole can be fastened by a manually operated tool for mounting the bracket on the engine head without being disturbed by the fuel injector socket. In the practical embodiment, the arm portions of the bracket are secured in parallel to the distribution tube at opposite sides of the fuel injector socket, and the stepped lateral rib is formed on the mounting plate portion between the periphery of the bolt hole and the periphery of the opening for the injection socket to enhance the structural rigidity of the mounting plate portion. Such structure of the bracket is useful to prevent the fuel injector socket from tilting movement caused by upward reaction force applied thereto so as to eliminate leakage of fuel from a sealed portion between the injector socket and the fuel injection valve. In a practical embodiment, it is preferable that the reinforced portion is formed upward or downward at one side edge of the mounting plate portion in the longitudinal direction of the distribution tube. This is effective to enhance bending rigidity of the mounting plate portion in a vertical plane parallel with the distribution tube so as to eliminate leakage of fuel from the sealed portion between the injector socket and the fuel injection valve.

DETAILED DESCRIPTION OF THE PREFERRED EMBODIMENTS

Figure 1:
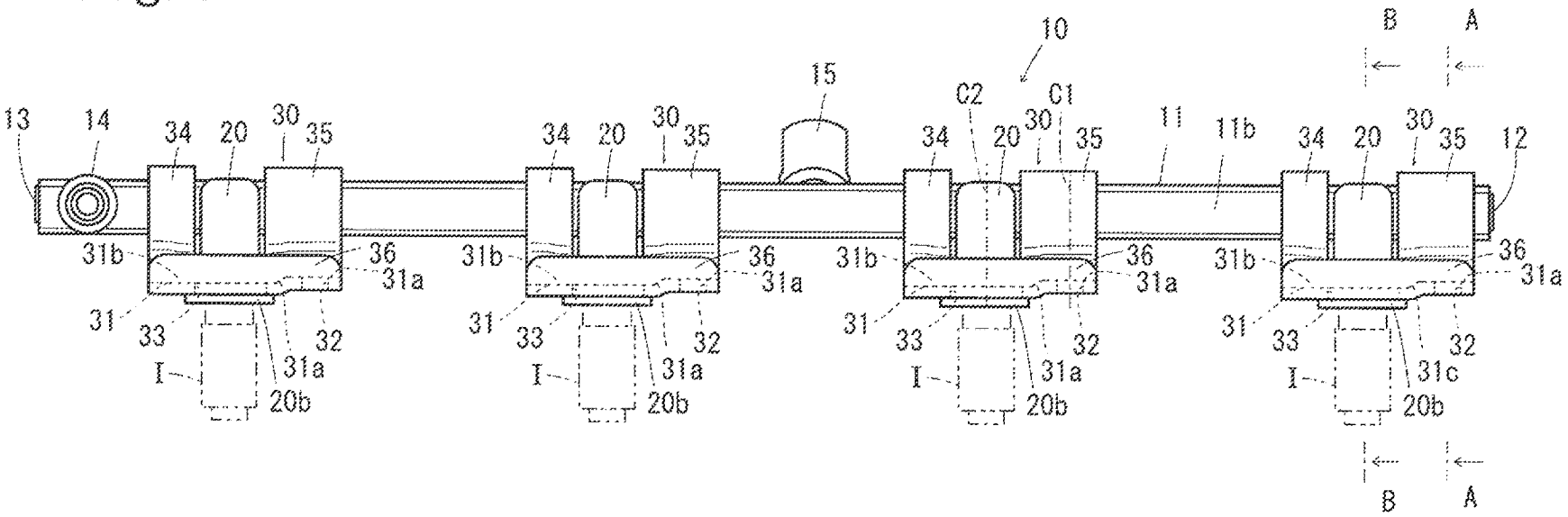
FIG. 1 is a front view of a fuel injector rail assembly in a preferred embodiment of the present invention.

A preferred embodiment of a fuel injector rail assembly according to the present invention will be described with reference to the accompanying drawings. The fuel injector rail assembly 10 is adapted for use in a direct-injection type engine of four series cylinders. As shown in FIG. 1, the fuel injector rail assembly 10 includes an elongate single fuel distribution tube 11 closed at its opposite ends by means of sealing plugs 12, 13, four fuel injector sockets 20 secured to the distribution tube 11 at equally spaced positions, four brackets 30 for mounting the fuel distribution tube on an engine head, a joint member 14 fixed to one end portion of the fuel distribution tube 11, and a sensor attachment member 15 fixed to an approximate center of the fuel distribution tube. These component parts are integrally assembled and secured in place by brazing. After a brazing process, surface treatment of the component parts is carried out by plating.

Figure 3:
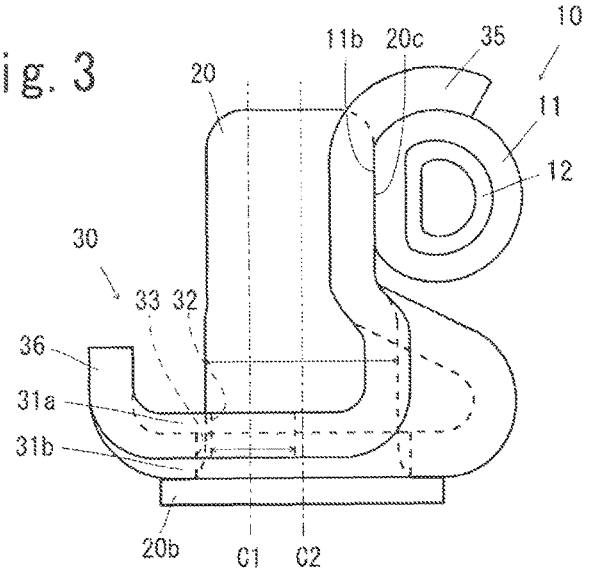
FIG. 3 is a right-side view of the fuel injector rail assembly shown in FIG. 1.
Figure 4:
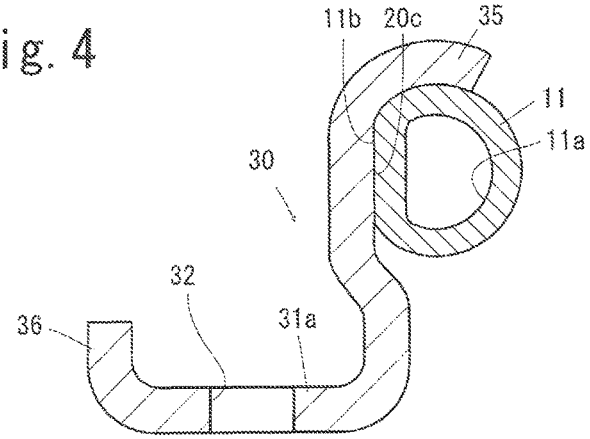
FIG. 4 is a cross-sectional end view taken along A-A line in FIG. 1.
Figure 5:
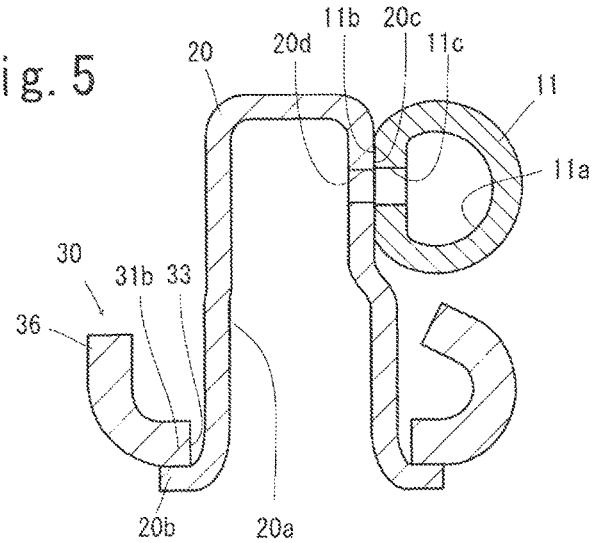
FIG. 5 is a cross-sectional end view taken along B-B line in FIG. 1.

The fuel distribution tube 11 is in the form of a straight steel pipe cut in a predetermined length. As shown in FIGS. 4 and 5, a fuel passage 11*a* is formed in the distribution tube 11. As shown in FIGS. 3~5, the distribution tube 11 is formed by drawing or extrusion mold to have a cross-section of D-letter shape. As shown in FIG. 5, a lateral through hole 11*c* is formed in a vertical planar portion 11*b* of distribution tube 11 at a position respectively corresponding with equally spaced fuel injection valves I inserted into an engine head. The through hole 11*c* is in open communication with a lateral hole 20*d* formed in a peripheral wall of each fuel injector socket 20 to provide communication between the fuel passage 11*a* and the internal space of fuel injector socket 20. A fuel supply conduit (not shown) is fixedly fastened to the joint member 14 by means of a union-nut (not shown) for supplying pressurized fuel from a high pressure fluid pump. A pressure sensor (not shown) is mounted onto the sensor attachment member 15 for detecting fuel pressure in the fuel passage 11*a*.

Figure 2:
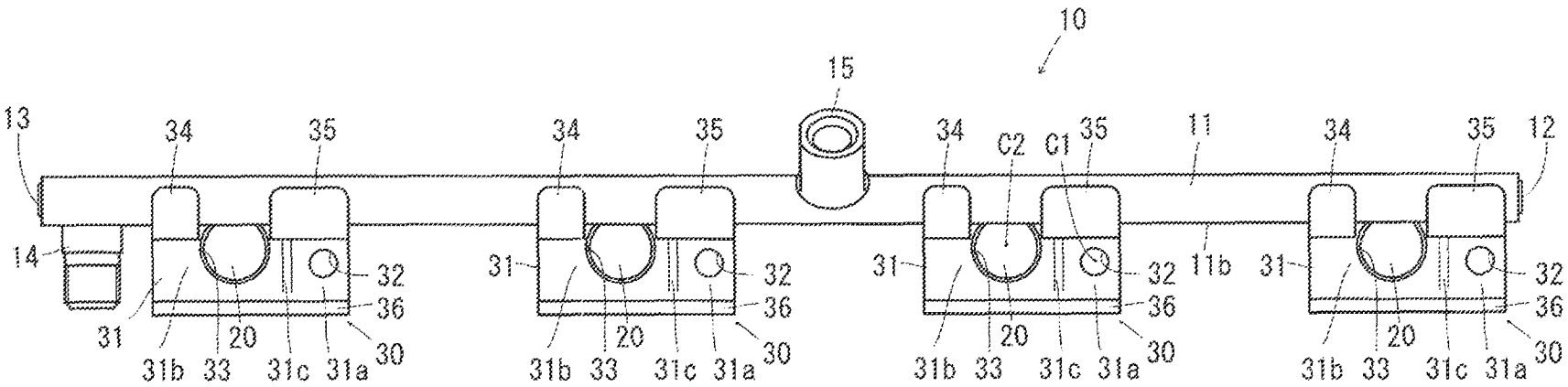
FIG. 2 is a plan view of the fuel injector rail assembly shown in FIG. 1.

As shown in FIGS. 1 and 2, four brackets 30 are securely fixed to the distribution tube 11 respectively at a position adjacent each fuel injector socket 20 for mounting the distribution tube 11 on the engine head. The brackets 30 each are made of pressed sheet-metal to include a mounting plate portion 31 located at the same height as the lower end of each fuel injector socket 20 and extending in a longitudinal direction of distribution tube 11, a pair of stationary arm portions 34, 35 extended to the upper surface of distribution tube 11 from a side edge of mounting plate portion 31 located at one side of distribution tube 11, and a reinforced portion 36 bent upward from a side edge of mounting plate portion 31 located at the opposite side of distribution tube 11. The mounting plate portion 31 of each bracket 30 has a semi-circular opening 33 formed to permit the lower portion of fuel injector socket 20 passing therethrough. A lower end flange 20*b* of fuel injector socket 20 is secured to the underside surface of the peripheral portion of semi-circular opening 33. As shown in FIGS. 1~3, the central axis C1 of bolt hole 32 is offset from the central axis C2 of fuel injector socket 20 in a direction apart from the distribution tube to facilitate fastening work of a bolt threaded into the bolt hole 32.

As shown in FIGS. 1 and 2, the mounting plate portion 31 is formed with a stepped lateral rib 31*c* between a periphery 31*a* of bolt hole 32 and a periphery 31*b* of semi-circular opening 33. The stepped lateral rib 31*c* is extended perpendicularly to the distribution tube 11 to enhance structural rigidity of the mounting plate portion 31.

As shown in FIG. 1~4, a pair of stationary arm portions 34, 35 are extended in parallel from one side edge of mounting plate portion 31 and formed to enclose the distribution tube 11. The arm portions 34, 35 are placed at opposite sides of fuel injector socket 20 and secured to the vertical planar portion 11*b* and an upper circular arc surface of distribution tube 11. The reinforced portion 36 is bent upward at one side edge of mounting plate portion 31 apart from the distribution tube 11 to enhance structural rigidity of the mounting plate portion 11 in a vertical plane parallel with the distribution tube 11.

In a manufacturing process of the fuel injector rail assembly 10, the fuel injector socket 20 is inserted into the assembly through the semi-circular opening 33 of bracket 30 and is secured at its bottom end flange 20*b* to the underside surface of the peripheral portion of opening 33 for manufacturing a sub-assembly of fuel injector socket 20 and bracket 30. Thereafter, the sealing plugs 12, 13 are fixedly coupled with the opposite ends of distribution tube 11, and the joint member 14 is prefixed to the distribution tube 11 adjacent its one end by welding. Further, the sensor attachment member 15 is prefixed to the central portion of distribution tube 11 by welding, and the pre-assembly of fuel injector socket 20 and bracket 30 is prefixed to the distribution tube 11 by welding in such a manner that the lateral through hole 11*c* is aligned with the lateral hole 20*d* of fuel injector socket 20. Thus, the component parts are secured in place to the distribution tube 11 in a fluid-tight manner by brazing. In the sub-assembly of fuel injector socket 20 and bracket 30, it is to be noted that the vertical planar portion 20*c* of fuel injector socket 20 is fluid-tightly secured to the vertical planar portion 11*b* of distribution tube 11 without any gap as shown in FIG. 3. It is also to be noted that the arm portions 34, 35 of bracket 30 are fluid-tightly secured to the vertical planar portion 11*b* of distribution tube 11 as shown in FIG. 4.

In the fuel injector rail assembly 10, the manufacturing cost of the brackets 30 can be reduced since they are made of pressed sheet metal. The bolt hole 32 and semi-circular opening 33 formed in the mounting plate portion 31 of each bracket 30 are useful to enhance precision of the placement of fuel injector sockets 20 and brackets 30 and to facilitate the mounting work of the fuel injector rail assembly to the engine head.

As the outward flange 20*b* formed on the lower end of fuel injector socket 20 is secured to the underside surface of mounting plate portion 31 at the periphery of semi-circular opening 33, the mounting plate portion 31 of bracket 30 is applied with an upward reaction force caused by ejection of high pressure fuel from the fuel injection valve I thereby to restrain load acting on the fuel distribution tube 11. As the pair of arm portions 34, 35 of each bracket 30 are secured to the upper surface and vertical planar surface of distribution tube 11 at the opposite sides of each fuel injector socket 20 in the longitudinal direction of tube 11, the brackets 30 are firmly retained in place against load caused by vertical and lateral vibrations of the engine.

In each bracket 30, the central axis C1 of mounting hole 32 is offset relative to the central axis C2 of fuel injector socket 20. With such arrangement of the mounting hole 32, a bolt threaded into the bolt hole 32 can be fastened by a manually operated tool for mounting the bracket 30 on the engine head without being disturbed by the fuel injector socket 20.

As described above, the arm portions 34, 35 of bracket 30 are secured in parallel to the distribution tube 11 at opposite sides of the fuel injector socket 20, and the stepped lateral rib 31*c* is formed between the periphery 31*a* of bolt hole 32 and the periphery 31*b* of opening 33 to enhance the structural rigidity of mounting plate portion 31. Such structure of the bracket 30 is useful to prevent the fuel injector socket 20 from tilting movement caused by upward reaction force applied thereto so as to eliminate leakage of fuel from a sealed portion between the injector socket 20 and fuel injection valve I. Further, the reinforced portion 36 formed upward at one side edge of mounting plate portion 31 and extending in the longitudinal direction of distribution tube 11 is effective to enhance bending rigidity of the mounting plate portion 31 in a vertical plane parallel with the distribution tube 11 so as to eliminate leakage of fuel from the sealed portion between the injector socket 20 and fuel injection valve I.

While in the embodiment described above, the central axis C1 of bolt hole 32 is offset from the central axis C2 of fuel injector socket 20 in the direction apart from the distribution tube 11, it is apparent that the central axis C1 of bolt hole 32 may be offset relative to the central axis C2 of fuel injector socket 20 in a direction approach to the distribution tube 11. In such a modification, the arm portions 34, 35 and stepped lateral rib 31*c* are useful to restrain tilting movement of the fuel injector socket 20 caused by an upward reaction force and to eliminate leakage of fuel from the sealing portion between the injector socket 20 and fuel injection valve I. Similarly, the central axis C1 of bolt hole 32 and the central axis C2 of fuel injector socket 20 may be apart from the distribution tube 11 in the same distance. In this modification, tilting movement of the fuel injector socket 20 caused by an upward reaction force is restrained by the arm portions 34, 35 and stepped lateral rib 31*c* of bracket 30 to eliminate leakage of fuel from the sealing portion between the injector socket 20 and fuel injection valve I.

The embodiment of the present invention may be modified as described below. The pair of arm portions of bracket 30 secured to the elongate vertical planar portion 11*b* of distribution tube 11 may be further extended to be secured to an elongate planar portion of tube 11 opposed to the elongate vertical planar portion 11*b* and/or a bottom portion of distribution tube 11. In this modification, it is able to more firmly secure the bracket 30 to the distribution tube 11. In addition, the reinforced portion 36 of mounting plate portion 31 may be bent downward.

What is claimed is:

1. A fuel injector rail assembly for direct injection of fuel, said rail assembly comprising an elongate fuel distribution tube formed with a fuel passage therein and a vertical planar portion at an external side thereof, a plurality of fuel injector sockets each formed to contain therein a fuel injection valve for supplying pressurized fuel from said fuel distribution tube to an internal combustion engine and integrally secured to the vertical planar portion of the fuel distribution tube to provide fuel communication between the fuel passage of the distribution tube and an interior of the fuel injector socket, and a plurality of brackets, each bracket being made of pressed sheet metal and having a mounting plate portion formed with a bolt hole for mounting the fuel distribution tube on an engine head and with a semi-circular opening for inserting lower portion of a respectively corresponding fuel injector socket therethrough, and with a pair of stationary arm portions extended in parallel from one side edge of said mounting plate portion at opposite sides of said respective fuel injector socket and secured to the vertical planar portion of said distribution tube, and wherein an outward flange formed at a lower end of said injector socket is secured to an underside surface of said semi-circular opening, and wherein a central axis of said bolt hole is offset from a central axis of each of said fuel injector sockets in a longitudinal direction of said distribution tube.

2. The fuel injector rail assembly as in claim 1, wherein the stationary arm portions of said bracket are extended in parallel upward from one side edge of each mounting plate portion of said bracket and secured to the vertical planar portion and an upper surface of said fuel distribution tube.

3. The fuel injector rail assembly as in claim 1, wherein a stepped lateral rib is formed on the mounting plate portion of said bracket between the bolt hole and the opening for said injector socket to reinforce the mounting plate portion of said bracket.

4. The fuel injector rail assembly as in claim 1, wherein the mounting plate portion of said bracket includes a reinforced portion bent upward from its side edge located at the opposite side of said distribution tube.

5. A fuel injector rail assembly for direct injection of fuel, said rail assembly comprising a fuel distribution tube forming a fuel passage to be supplied with fuel under pressure from a fuel pump, a plurality of fuel injector sockets, each socket being formed to contain therein a fuel injection valve for supplying fuel from said fuel distribution tube to an internal combustion engine and each socket integrally secured to a vertical planar side portion of the fuel distribution tube at equally spaced positions to provide fuel communication between the fuel passage of the fuel distribution tube and an interior of each respectively associated fuel injection socket, and a plurality of brackets, each socket being made of pressed sheet metal and integrally secured to the vertical planar side portion of the fuel distribution tube, wherein said brackets each include a mounting plate portion formed with a bolt hole for mounting said fuel distribution tube on an engine head and a semi-circular opening formed to permit insertion of a lower end portion of a respectively corresponding injector socket therethrough, and a pair of stationary arm portions extended in parallel from one side edge of the mounting plate portion at opposite sides of a respectively associated fuel injector socket and secured to the vertical planar side portion of said fuel distribution tube, wherein an outward flange formed at a lower end of said injector socket is secured to an underside surface of the periphery of said opening, and wherein a central axis of the bolt hole is offset from a central axis of each of said fuel injector sockets in a longitudinal direction of said distribution tube.

6. The fuel injector rail assembly as in claim 5, wherein said fuel distribution tube has a cross-section of D-letter shape, and the arm portions of said bracket are extended in parallel upward from one side edge of the mounting plate portion and secured to a vertical planar side surface and an upper surface of the fuel distribution tube.

7. The fuel injector rail assembly as in claim 5, wherein the mounting plate portion of said bracket includes a stepped lateral rib formed thereon between the bolt hole and the opening for an injector socket and a reinforced portion bent upward from its side edge located at an opposite side of said distribution tube.

* * * * *